US005112091A

United States Patent [19]

Klüting

[11] Patent Number: 5,112,091

[45] Date of Patent: May 12, 1992

[54] DOOR HOLDING DEVICE FOR MOTOR VEHICLE DOOR

[75] Inventor: Bernd A. Klüting, Radevormwald, Fed. Rep. of Germany

[73] Assignee: Ed. Scharwächter GmbH & Co. KG, Remscheid, Fed. Rep. of Germany

[21] Appl. No.: 635,768

[22] Filed: Dec. 28, 1990

[30] Foreign Application Priority Data

Dec. 30, 1989 [DE] Fed. Rep. of Germany ..... 3943407

[51] Int. Cl.[5] ..... E05C 17/20

[52] U.S. Cl. ..... 292/262; 292/DIG. 61

[58] Field of Search ..... 292/262, 275, 277, 193, 292/267, DIG. 61

[56] References Cited

U.S. PATENT DOCUMENTS

| | | | |
|---|---|---|---|
| 112,210 | 2/1871 | Bird | 292/275 |
| 175,991 | 4/1876 | Iden | 292/275 |
| 2,523,088 | 9/1950 | Beyer | 292/275 X |
| 3,001,811 | 9/1961 | Erickson | 292/275 |
| 3,427,895 | 2/1969 | Jackson et al. | 292/275 X |
| 4,772,054 | 9/1988 | Schreiber et al. | 292/275 |
| 4,997,221 | 3/1991 | Tölle et al. | 292/275 |

*Primary Examiner*—Richard E. Moore
*Attorney, Agent, or Firm*—Toren, McGeady & Associates

[57] ABSTRACT

A door holding device for a motor vehicle door includes a door holding rod which is pivotally connected to a door installation member, door or door post. The door holding rod is provided with locking portions for holding the door in predetermined positions and with an end stop for holding the door in an end position. A holder housing is rigidly connected to an other door installation member. The door holding rod extends through the holder housing. A first roller is mounted in the holder housing so as to be rotatable about a rigid axis. A second roller is rotatably mounted on a load-applying arm of a torsion rod spring which rests against the holder housing. The door holding rod extends between the two rollers. The door holding rod has over its entire length which comes into contact with the rollers a rounded cross-sectional shape and the locking portions are formed by at least one bent portion of the door holding rod directed transversely of the longitudinal axis of the door holding rod.

19 Claims, 5 Drawing Sheets

DOOR HOLDING DEVICE FOR MOTOR VEHICLE DOOR

BACKGROUND OF THE INVENTION

1. Field of the Invention

The present invention relates to a door holding device for a motor vehicle door. The device includes a door holding rod which is pivotally connected by means of a bearing block to a door installation member, door or door post and is provided with locking means determining the positions in which the door is to be locked and with an end stop means determining the end position of the door. The device further includes a holder housing which is rigidly connected to another door installation member. The door holding rod extends through the holder housing. A first roller as an abutment roller is mounted in the holder housing so as to be rotatable about a rigid axis. A second roller as a load-applying roller is rotatably mounted on a load-applying arm of a torsion rod spring which rests against the holder housing by means of a support arm. The door holding rod extends between the two rollers.

2. Description of the Related Art

In known door holding devices of this type, the door holding rod has an essentially rectangular cross-section and the locking means determining the positions in which the door is to be locked are formed by recesses in a narrow side of the door holding rod which cooperates with the load-applying roller. The two oppositely located rollers, i.e., the load-applying roller and the abutment roller, interact each with one of the two narrow sides of the door holding rod through cylindrical smooth running surfaces. This results in the disadvantage that, when the hinge axis of the door holding rod is aligned at an angle relative to the roller axes, the door holding rod is guided at an angle relative to the running surfaces of the rollers, so that there is an insufficient holding force of the door holding device, on the one hand, and, on the other, an increased wear of the door holding device, particularly resulting in a development of noise.

Therefore, door holding devices of the above-described type must be manufactured with high precision and consequently are difficult and expensive to manufacture. Moreover, this type of door holding device requires a particularly careful alignment of the components to be fastened to the two door insulation members, door and door posts, i.e., holder housing and bearing block, so that the assembly of the door holding device in the motor vehicle body is also time-consuming and therefore expensive.

Furthermore, particularly due to the assembly machines used in modern automobile manufacture, when the door which has originally been adjusted and aligned in the unfinished vehicle body is reassembled, it is difficult to avoid slight deformations of the door body and of the door posts and it is therefore very difficult to ensure an exact relative alignment of roller axes and hinge axis of the door holding rod.

SUMMARY OF THE INVENTION

It is, therefore, the object of the present invention to improve a door holding device of the above-described type, so that deviations in the positions of the axes of the rollers and of the hinge axis of the door holding rod due to manufacture and assembly are absorbed by the door holding device without requiring special adjustments and without increasing the manufacturing cost of the door holding device, so that all disadvantageous consequences of such tolerances are avoided.

In accordance with the present invention, the door holding rod has over its entire length which comes into engagement with the rollers a rounded cross-sectional shape and the locking means determining the locking positions of the door are formed by at least one bent portion of the door holding rod directed transversely of the longitudinal axis of the door holding rod.

The present invention particularly provides that the door holding rod has over its entire length which is in engagement with the rollers a cross-sectional shape which deviates from the circular shape as well as from the polygonal shape.

The construction of the door holding device according to the present invention and particularly the rounded cross-sectional shape of the door holding rod ensure that the door holding rod is always in contact with a sufficient portion of its circumferential surface with the two rollers, i.e., abutment roller and load-applying roller, without any possible angular misalignment, independently of any relative angular positions of the axes of the two rollers and of the hinge axis of the door holding rod and also independently of any vertical misalignment between the bearing block and the holder housing. Accordingly, it is not possible that increased wear or any noise development resulting from the wear can occur during operation of the door holding device either due to assembly tolerances or due to manufacturing tolerances.

In most cases, from the viewpoint of manufacturing the door holding device and also from the viewpoint of the operation thereof, a circular cross-sectional shape of the door holding rod is preferred, unless there are reasons for using an oval or similar cross-sectional shape.

The manufacture of the door holding device is particularly simplified if the door holding rod is made from a blank of a round bar and has a uniform cross-sectional shape over the entire length which comes into engagement with the rollers.

In the simplest case, either both or only one of the two rollers interacting with the door holding rod, i.e., the abutment roller or the load-applying roller, may have a smooth cylindrical circumferential surface and, thus, may have a linear contact with the circumferential surface of the door holding rod.

In accordance with a particularly preferred further development of the invention, the running surface of at least one of the rolls has a shape which deviates from the cross-sectional shape of the door holding rod. Two useful embodiments are possible. First, the running surface of at least one of the rollers may have an inwardly arched sectional shape, wherein the arch of the running surface has a smaller diameter than the diameter of the door holding rod. Second, the running surface of at least one of the rollers may have an inwardly arched sectional shape, wherein the arch of the running surface has a greater diameter than the diameter of the door holding rod.

In accordance with an advantageous feature, the circumferential surfaces of both rollers have the same cross-sectional shape or indentation and the indentations have such a depth that the rollers extend at least around half the circumference of the door holding rod when the door holding rod has a circular cross-section. The interaction of the cross-sectional shape of the door holding rod and the cross-sectional shapes of the two rollers interacting with the door holding rod have the result that, when the door holding rod and the rollers move out of the ideal relative alignment of the running surfaces, the door holding rod rests against the inner surfaces of the cross-sectional shapes of the two rollers and, thus, an angular misalignment cannot take place.

In accordance with another embodiment, the door holding rod has a cylindrical smooth circumferential surface and a roller provided with a profiling of the circumferential surface cooperates with the door holding rod, wherein advantageously the circumferential surface of the abutment roller is smooth and cylindrical.

A further development of the invention provides that the door holding rod has at least two locking means which are arranged successively and are formed by wave-shaped deformations which are directed transversely of the longitudinal direction of the door holding rod. The end stop means for the door is formed by an end angle portion of the door holding device which extends at approximately a right angle. With respect to the end stop means for the door, it may also be provided that the door holding rod has in the region of the end stop means a cross-sectional shape which deviates from its remaining cross-sectional shape, particularly a pear-shaped cross-sectional shape.

However, within the scope of the present invention to the free end of the door holding rod may be attached an end stop means formed by a conventional body attached to the door holding rod, particularly a rubber block.

For an advantageous manufacture of the door holding device it may additionally be provided that the door holding rod is made by bending a chiplessly deformed piece, wherein a bearing eye for supporting the door holding rod in the bearing block is formed in one piece with the door holding rod, particularly by flattening the material of the door holding rod.

On the other hand, a bearing eye formed by a cylinder sleeve may also be attached to the door holding rod, particularly by means of welding.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
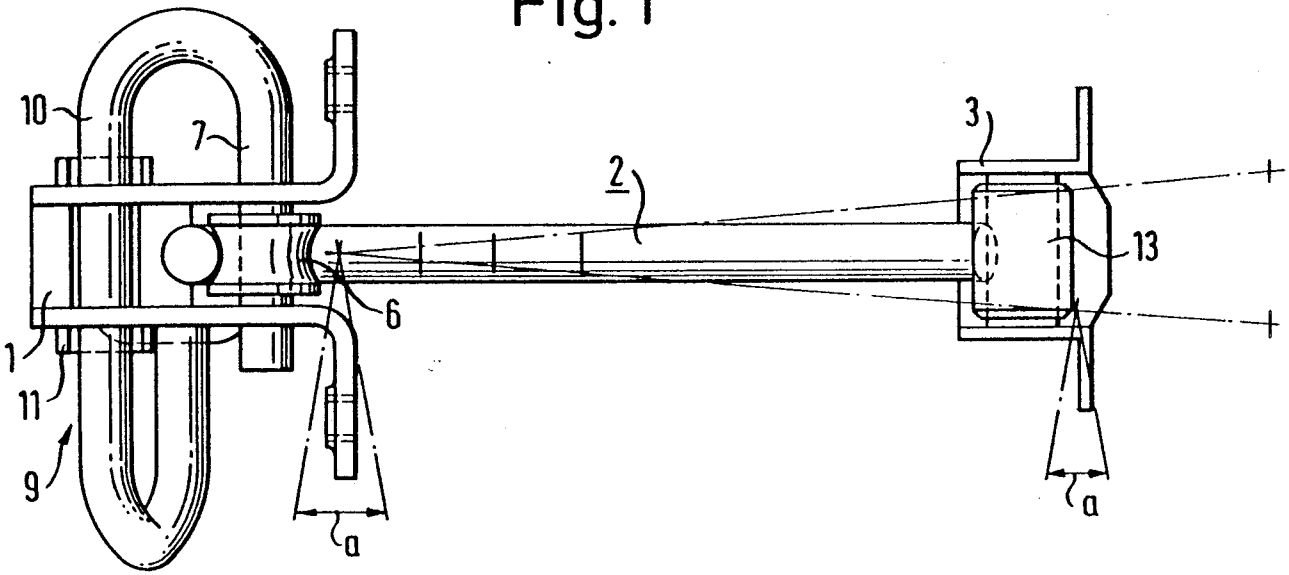
FIG. 1 is a schematic top view of a door holding device.

The door holding device according to the present invention includes a holder housing 1 which is made from a blank of flat material bent so as to be U-shaped. The holder housing 1 is rigidly connected to a door installation member. A door holding rod 2 extends through the holder housing 1. A bearing block 3 which supports the door holding rod 2 if fastened to another door installation member.

A roller 4 forming an abutment roller is mounted so as to be rotatable about a rigid axis 5 on the holder housing 1. A roller 6 forming a load-applying roller is mounted in the holder housing 1 opposite the roller 4 relative to the door holding rod 2. The roller 6 is rotatably supported on a free load-applying arm of a torsion rod spring 9 which rests against the holder housing 1 through a support arm 8. The torsion rod spring 9 is supported in the holder housing 1 through a shaft member 10 by means of a bearing shell 11.

Figure 3:
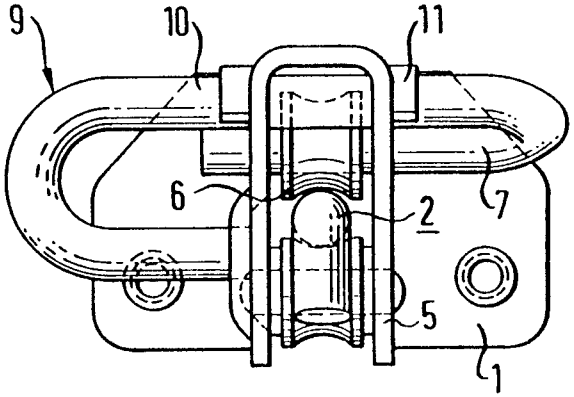
FIG. 3 is a front view of the door holding device of FIGS. 1 and 2.
Figure 2:
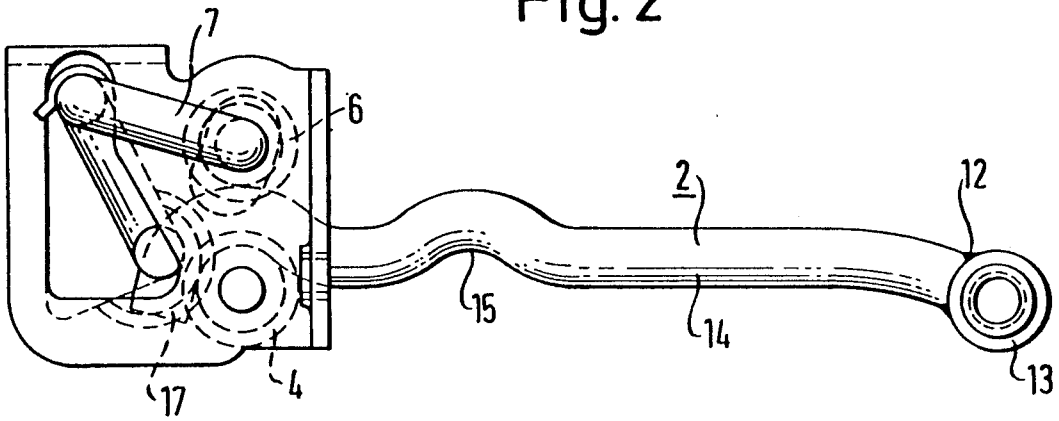
FIG. 2 is a side view of the door holding device of FIG. 1.

In the embodiment shown in FIGS. 1–3, the door holding rod 2 is pivotally mounted in the bearing block 3 about an axis extending parallel to the door hinge axis by means of a cylindrical sleeve 13 which forms a bearing eye and is connected by a welded connection 12 to one end of the door holding rod 2. Along the freely movable length of the door, the door holding rod 2 has an essentially straight portion 14 and locking means 15, 16 adjacent the straight portion 14 and an end stop means 17.

Figure 4:
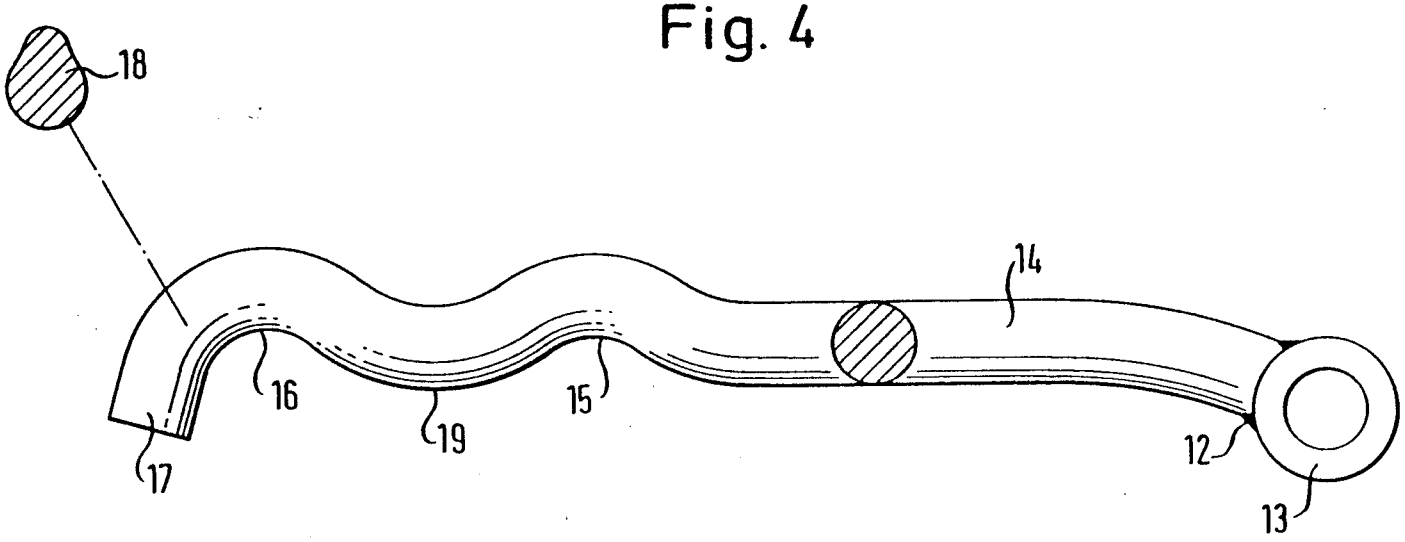
FIG. 4 is a side view of a door holding rod for a door holding device according to FIGS. 1 to 3.
Figure 7:
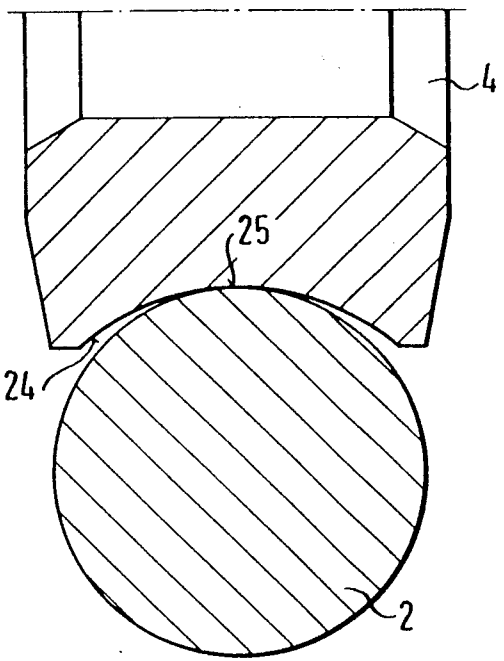
FIG. 7 is a sectional view of a third embodiment of a roller interacting with a door holding rod.
Figure 6:
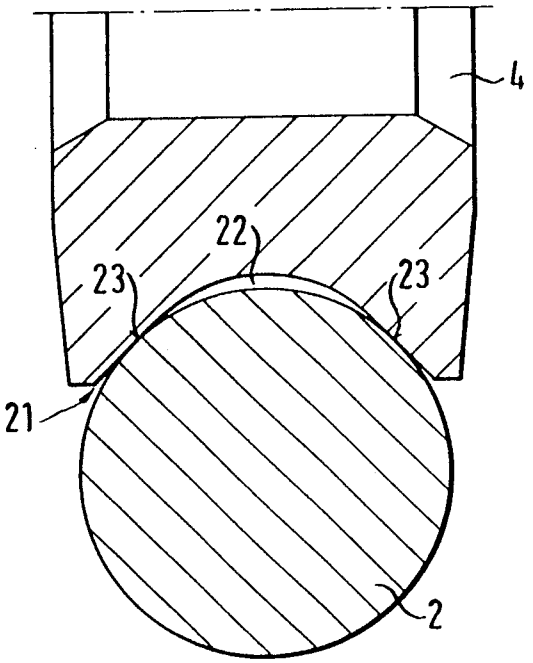
FIG. 6 is a sectional view of a second embodiment of a roller interacting with a door holding rod.
Figure 5:
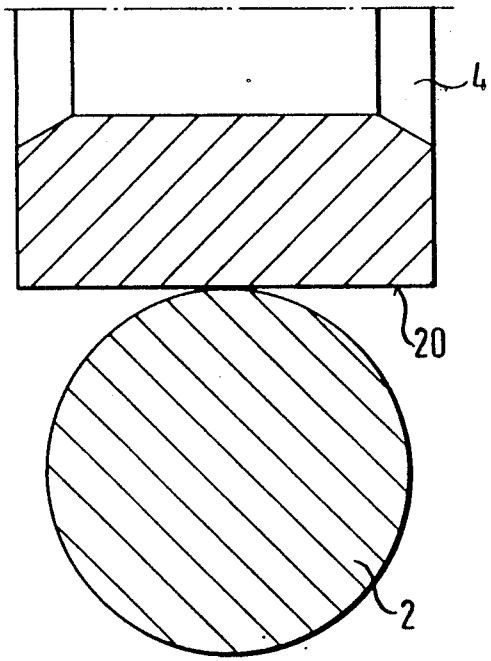
FIG. 5 is a sectional view of a first embodiment of a roller interacting with a door holding rod.

As particularly illustrated in FIG. 4, the door holding rod 2 has a circular cross-sectional shape over the length portion which is in engagement with the rollers 4 and 6, while the door holding rod 2 has an approximately pear-shaped cross-sectional shape 18 in the region of the end stop means 17. The two locking means 15 and 16 are formed by wave-shaped deformations of the door holding rod 2 which are directed transversely of the longitudinal axis thereof. A straightened immediate portion 19 extends between the locking means 15 and 16. The locking means 15 and 16 are spaced apart from each other in accordance with the different positions in which the door is to be locked As illustrated in FIGS. 5–7, the rollers 4 and/or 6 which interact with the door holding rod 2 may have a circumferential profile. In the simplest case, as shown in FIG. 5, the roller 4 may have a smooth cylindrical circumferential surface 20. In the embodiment of FIG. 6, the roller 4 has a concave inwardly directed shape of the circumferential surface 21, wherein the radius of curvature 22 of the concave surface is smaller than the diameter of the circular cross-sectional shape of the door holding rod 2, so that the roller 4 rests against the outer circumference of the door holding rod 2 only with the two side portions 23 of the concave surface 22. In the embodiment of FIG. 7, the roller 4 also has an inwardly directed circumferential shape 24, however, the circumferential surface 24 has a radius of curvature which is greater than the diameter of the cross-sectional area of the door holding rod 2, so that the roller 4 rests against the outer circumference of the door holding rod 2 only with the bottom portion 25 of the circumferential surface 24.

In the embodiments shown in FIGS. 6 and 7, the roller 4 engages around the outer circumference of the door holding rod 2 by about one-third, so that, as is shown particularly in the illustration of FIG. 3, the door holding rod 2 is engaged by the rollers 4 and 6 at least over half the outer circumference of the door holding rod 2.

Figure 8:
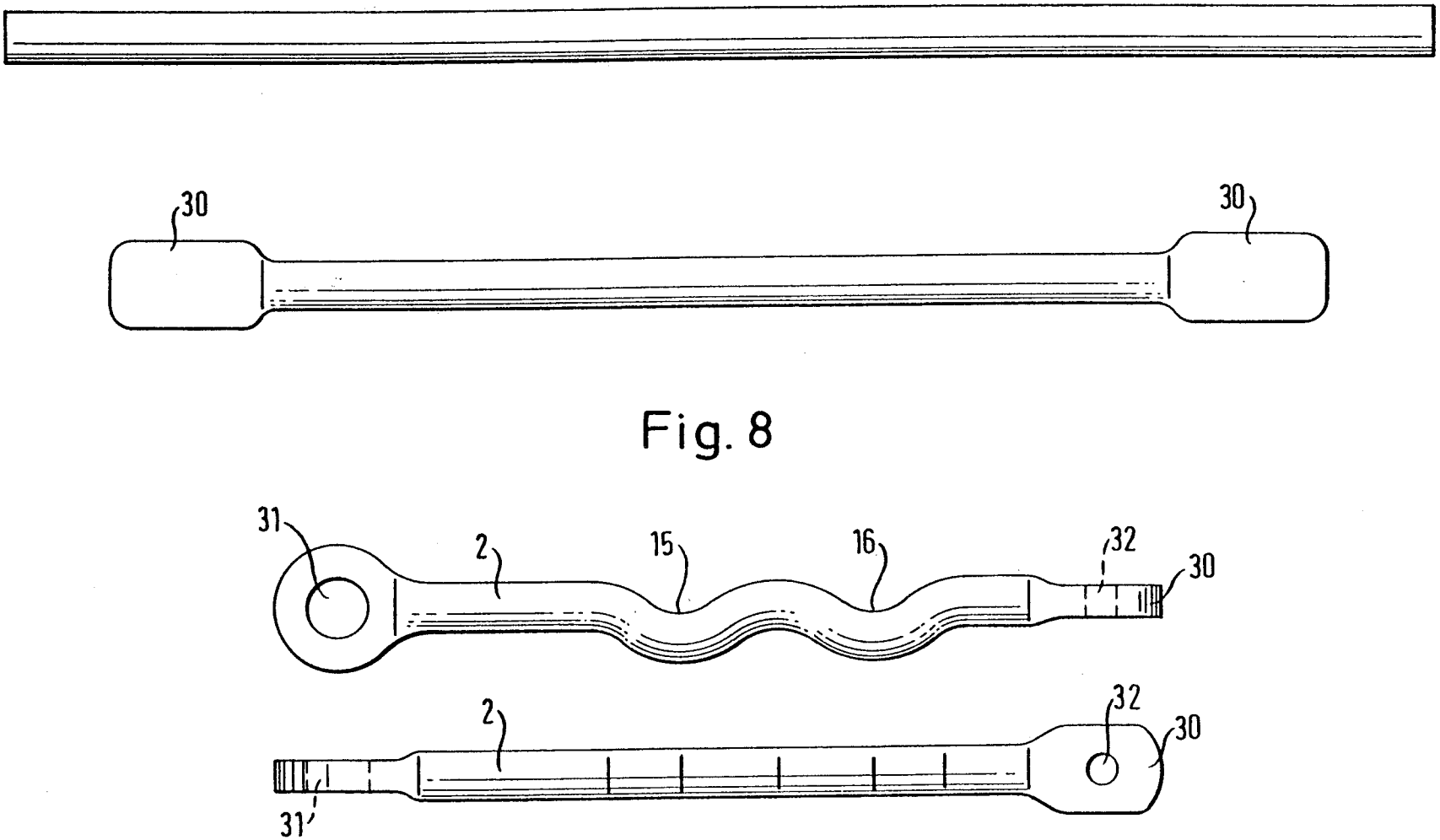
FIG. 8 is an illustration of the stages of deformation of the door holding rod when the door holding rod is manufactured.
Figure 9:
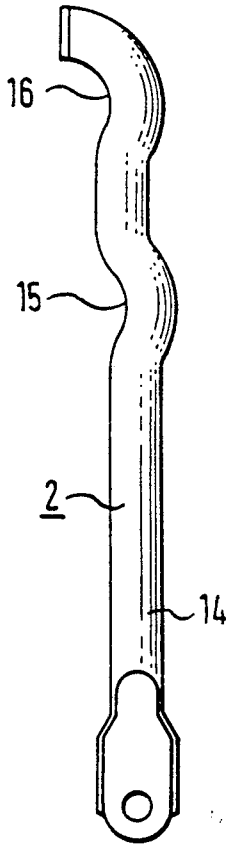
FIG. 9 is a side view of another embodiment of a door holding rod.
Figure 10:
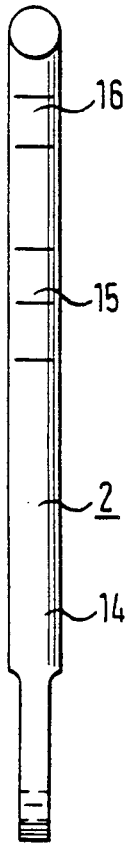
FIG. 10 is a top view of the door holding rod of FIG. 9.

In the embodiment shown in FIGS. 9 and 10, the door holding rod 2 is constructed in one piece and is provided with a bearing eye 26 which is arranged in a flattened end portion 27 of the door holding rod 2. The method of manufacturing the door holding rod 2 shown in FIGS. 9 and 10 is illustrated in FIG. 8. As is clear from FIG. 8, a straight blank of a round material rod having a circular initial cross-section is initially upset at both ends to provide flattened portions 30. The two flattened portions 30 are subsequently deformed at one end to a bearing eye 31 and at the other end to form a throughbore 32 for fastening a member which serves as an end stop means. In the illustrated embodiment, the two end portions 30 and 31 are offset relative to each other by 90°. Finally, the blank deformed in the above-described manner is then bent over a portion of the length of the door holding rod to form locking means 15 and 16 which are wave-like and extend transversely of the longitudinal direction of the door holding rod.

As can be additionally seen from FIG. 1, any manufacturing or assembly tolerances which result in a relative rotation of the door holding rod to the plane of the two rollers 4 and 6 do not cause an angular misalignment of the door holding rod relative to the rollers 4 and 6. Moreover, any assembly tolerances which may result in a vertical displacement of the holder housing 2 relative to the bearing block 3 also do not lead to an angular misalignment of the door holding rod 2 relative to the rollers 4 and 6. Rather, as the figures of the drawing show, when the door holding rod 2 is deflected from the ideal direction of movement or alignment, the door holding rod 2 still rests against and is guided by the side portions of the circumferential surfaces of the rollers 4 and 6.

While specific embodiments of the invention have been shown and described in detail to illustrate the inventive principles, it will be understood that the invention may be embodied otherwise without departing from such principles.

I claim:

1. In a door holding device for a motor vehicle door, including a door holding rod which is pivotally connected by means of a bearing block to a first door installation member, the door holding rod being provided with locking means for holding the door in predetermined positions and with an end stop means for holding the door in an end position, the device further including a holder housing rigidly connected to a second door installation member, the door holding rod extending through the holder housing, a first abutment roller being mounted in the holder housing so as to be rotatable about a rigid axis, a torsion rod spring resting against the holder housing by means of a support arm, the torsion rod spring having a load-applying arm, a second load-applying roller being rotatably mounted on the load-applying arm, the door holding rod extending between the two rollers, the door holding rod having a longitudinal axis and a length which comes into engagement with the rollers, the improvement comprising the door holding rod having over the entire length which comes into engagement with the rollers a rounded cross-sectional shape, the locking means being at least one bent portion of the door holding rod, the at least one bent portion being directed transversely of the longitudinal axis of the door holding rod.

2. The door holding device according to claim 1, wherein the door holding rod has a uniform cross-sectional shape over the entire length which comes into engagement with the rollers.

3. The door holding rod according to claim 1, wherein the door holding rod has at least two locking means formed by wave-like bent portions directed transversely of the longitudinal axis of the door holding rod.

4. The door holding rod according to claim 1, wherein the end stop means is an end portion of the door holding rod bent at approximately a right angle.

5. The door holding rod according to claim 1, wherein the door holding rod has over the entire length which comes into engagement with the rollers a circular cross-sectional shape.

6. The door holding rod according to claim 1, wherein the door holding rod has at the end stop means a cross-sectional shape which differs from the rest of the door holding rod.

7. The door holding rod according to claim 1, wherein the door holding rod has at the end stop means a pear-shaped cross-sectional shape.

8. The door holding rod according to claim 1, wherein the rollers have circumferential running surfaces, the running surface of at least one of the rollers having a shape which differs from the cross-sectional shape of the door holding rod.

9. The door holding rod according to claim 8, wherein the running surface of at least one of the rollers is inwardly arched, the arched running surface having a diameter and the door holding rod having a diameter, wherein the diameter of the running surface is smaller than the diameter of the door holding rod.

10. The door holding rod according to claim 8, wherein the running surface of at least one of the rollers is inwardly arched, the arched running surface having a diameter and the door holding rod having a diameter, wherein the diameter of the running surface is larger than the diameter of the door holding rod.

11. The door holding rod according to claim 9, wherein the door holding rod has a circumference, the two rollers extending at least around half the circumference of the door holding rod.

12. The door holding rod according to claim 10, wherein the door holding rod has a circumference, the two rollers extending at least around half the circumference of the door holding rod.

13. The door holding rod according to claim 1, wherein the rollers have circumferential running surfaces, the running surface of at least one of the rollers being cylindrically smooth.

14. The door holding rod according to claim 1, wherein the end stop means is a member attached to the door holding rod.

15. The door holding rod according to claim 1, wherein the end stop means is a rubber block.

16. The door holding rod according to claim 1, wherein the door holding rod comprises a bearing eye for effecting the pivotal connection in the bearing block, the bearing eye being formed integrally with the door holding rod.

17. The door holding rod according to claim 15, wherein the bearing eye is formed by flattening the door holding rod.

18. The door holding rod according to claim 1, wherein the door holding rod comprises a bearing eye for effecting the pivotal connection in the bearing block, the bearing eye being a cylindrical sleeve attached to the door holding rod.

19. The door holding rod according to claim 18, wherein the cylindrical sleeve is attached by welding.

* * * * *